US007247272B1

(12) United States Patent
Moerman et al.

(10) Patent No.: US 7,247,272 B1
(45) Date of Patent: Jul. 24, 2007

(54) METHOD OF THE DOSED APPLICATION OF A LIQUID ONTO A SURFACE

(75) Inventors: Robert Moerman, Den Haag (NL); Johannes Frank, Schiedam (NL); Johannes Cornelis Maria Marijnissen, Breda (NL)

(73) Assignee: Technische Universiteit Delft, Julianalaan (NL)

( * ) Notice: Subject to any disclaimer, the term of this patent is extended or adjusted under 35 U.S.C. 154(b) by 0 days.

(21) Appl. No.: 09/868,408

(22) PCT Filed: Dec. 17, 1999

(86) PCT No.: PCT/NL99/00786

§ 371 (c)(1),
(2), (4) Date: Sep. 25, 2001

(87) PCT Pub. No.: WO00/35590

PCT Pub. Date: Jun. 22, 2000

(30) Foreign Application Priority Data

Dec. 17, 1998 (NL) ..... 1010833

(51) Int. Cl.
*B01L 3/02* (2006.01)

(52) U.S. Cl. ..... 422/100; 422/99; 422/101; 436/180; 222/52

(58) Field of Classification Search ..... 422/99–101; 436/180; 239/708; 222/52
See application file for complete search history.

(56) References Cited

U.S. PATENT DOCUMENTS 5,504,329 A * 4/1996 Mann et al. ..... 250/288
5,872,010 A * 2/1999 Karger et al. ..... 436/173
6,093,557 A * 7/2000 Pui et al. ..... 435/173.1
6,231,737 B1 * 5/2001 Ramsey et al. ..... 204/451
6,350,609 B1 * 2/2002 Morozov et al. ..... 435/283.1
2003/0092195 A1 * 5/2003 Moon et al. ..... 436/173

FOREIGN PATENT DOCUMENTS

WO WO 98/56894 12/1998
WO WO 98/58745 12/1998

OTHER PUBLICATIONS

Desai et al, A MEMS Electrospray Nozzle for Mass Spectroscopy, 1997 Internat'l Conf. on Solid State Sensors and Actuators (Transducers '97), May 1997, p. 927-930.*

* cited by examiner

*Primary Examiner*—Jill Warden
*Assistant Examiner*—Jyoti Nagpaul
(74) *Attorney, Agent, or Firm*—Jeffrey D. Myers; Janeen Vilven; Peacock Myers, P.C.

(57) ABSTRACT

The invention relates to a method of the dosed application of a liquid onto to selected portion of the surface of a substrate (A) by means of spraying under the influence of an electric current. According to the invention the liquid is fed at a flow rate between 0.01 pl/s and 1 ml/s to a distal tip (3) of a capillary (1) having an inside diameter of less than 150 μm, wherein the distance between the distal tip and the surface (A) is less than 2 mm. Surprisingly it has been shown that it is possible in this manner to apply liquid to a restricted surface of a defined size.

13 Claims, 3 Drawing Sheets

METHOD OF THE DOSED APPLICATION OF A LIQUID ONTO A SURFACE

The present invention relates to a method of the dosed application of a liquid onto a surface of a substrate, wherein the liquid is fed to a distal tip of a capillary at a flow rate between 0,01 pl/s and 1 ml/s, wherein the distal tip comprises an orifice directed toward a surface, the inside diameter of the capillary is less than 150 μm and a voltage is applied between the orifice and a counter electrode until the desired amount of liquid has been applied to the selected portion of the surface.

WO 98/58745 describes a method of electrospraying solutions to deposit substances, including biomacromolecules, in the form of spots and films on a substrate. Electrospraying occurs at a distance from the substrate of 15-40 mm. The application describes a focusing technique to create small spots of deposited material. This document was published after the priority date of the present application.

The present invention is characterized in that the distance between the orifice and the surface is less than 2 mm.

Surprisingly, applicant has found that by means of the electrospraying technique it is possible to apply liquid to a very small selected portion (having a (maximum) diameter of 1 cm or less) without any substantial amount of liquid landing outside of said selected portion. This will also not happen when application times are longer. Then a drop will form, without adversely affecting of the method.

EP-A-0,258,016 describes an electrostatic coating system suitable for applying a very thin coating to a substrate wherein, by means of a potential difference, a coating liquid is reduced to a mist of highly charged droplets, which charged droplets are drawn toward the substrate. Because the charged droplets have the same sign, they repel each other whereby a substantially even coating of the surface is achieved.

The term "capillary" as used in the present application, is understood to define any conduit that makes it possible to allow an aqueous liquid to pass through, and when mention is made of the width of a capillary, this (obviously) relates to the inside diameter of the conduit.

When speaking of the inside diameter of the capillary, this relates in particular to the inside diameter of the distal tip directed toward the substrate.

When speaking of the application of a voltage between the orifice and a counter electrode, then this comprises, as will be obvious to the person skilled in the art, the application of a voltage between the liquid in an electrically non-conductive orifice of the capillary and the counter electrode.

In this manner it is possible to apply liquid to a limited surface having a defined dimension.

This makes the method according to the present invention very suitable, for example, for the dosed application of a liquid to an object for performing an assay. The object may, for example, be a microtitre plate; a substrate such as can be manufactured using techniques known from the semiconductor industry, for example substrates based on silicon, and the like.

For performing an assay the liquid preferably comprises a biological particle selected from an unicellular organism, an enzyme, a probe for the detection of a nucleic acid sequence, an enzyme, a receptor and a ligand. It is also conceivable that small multi-cellular organisms and tissues are applied with the liquid, on condition that the inside diameter of the capillary permits this.

As probe for the detection of a nucleic acid sequence, an oligonucleotide such as well-known in the field, may conveniently be used. In the present application, receptor is understood to mean a ligand-specific protein. Such a receptor may, for example, be a membrane receptor. According to a very favourable embodiment the receptor is an antibody. Advantageously, at least the selected portion of the surface of the substrate is capable of covalently coupling the biological particle.

According to a favourable embodiment the application is performed in an atmosphere substantially saturated with vapour from the liquid.

This reduces the chance of Rayleigh-break up of charged droplets, and thus helps to avoid that liquid lands outside of the selected portion of the surface.

According to a further embodiment, application is performed in an atmosphere which, in comparison with atmospheric air, reduces the chance of discharge.

Therefore, as long as a possible biological activity of a biological particle present in the liquid is substantially not adversely affected, the chance of damage to the substrate may be reduced by using, for example, a nitrogen-depleted atmosphere. Compared with air, the atmosphere preferably comprises a relatively high content of one or more gasses having a relatively high electron affinity. For example, the atmosphere suitably comprises $SF_6$ or an elevated $CO_2$ content.

A very important embodiment of the method according to the present invention is characterized in that after the application of the liquid onto the selected portion of the surface, the substrate and the orifice are moved in relation to each other in a plane extending substantially perpendicular to the axis of the capillary, and in that a second selected portion of the surface is provided with liquid, which second selected portion does not overlap with the selected portion first provided with liquid.

Instead, or in addition, it is preferred to use an array of capillaries, with the capillaries spaced from each other such that the selected surfaces onto which liquid is to be applied by two neighbouring capillaries, do not overlap.

With the aid of such methods it is possible to select a large number of non-overlapping portions on the substrate, allowing many assays to be performed simultaneously.

According to a first embodiment the counter electrode is being formed by the substrate.

In such a case the substrate comprises a conductor or semiconductor, or the same have been applied to the substrate.

According to an alternative embodiment an electrode is used as counter electrode, which electrode substantially surrounds the selected portion of the surface and which is kept in the vicinity of the surface. In the present application the term "in the vicinity of the surface" is understood to mean adjacent or at a distance from the surface, on the understanding that in the latter case, the counter electrode is normally located at less than half the distance between the tip of the capillary and the substrate.

The advantage of this embodiment is that non-conductive substrates such as, for example, microtitre plates of polystyrene, can be provided with liquid with the aid of the method according to the present invention. This allows substrates having elevated concentrations of, for example antibodies, to be coated quickly without raising the costs resulting from wasting the starting material, since only small volumes of liquid are applied to the surface.

According to an interesting embodiment, the amount of applied liquid is measured by means of current and/or voltage characteristics.

This allows the dosage of the liquid to be monitored in time.

According to a preferred embodiment the flow rate varies between 1 pl/s and 1 nl/s, and preferably between 10 and 100 pl/s.

Such flow rates are very suitable for the application of minuscule amounts of liquid to a very small portion of the surface of the substrate. One might consider a portion having a surface area of 1 $mm^2$ or less, and in particular 0,1 $mm^2$ or less.

When applying liquid to a small selected portion having a surface area of 1 $mm^2$ or less, the distance between the orifice and the surface is, according to an advantageous embodiment, 200 to 1000 μm.

According to a favourable embodiment the selected portion of the surface is bounded by means for limiting the spreading of liquid over the surface.

In this way a substantially homogeneous coating of liquid is obtained on the selected portion and the chance of liquid landing outside the selected portion is reduced.

According to a first embodiment a substrate is used whose surface comprises a well with the selected portion being comprised of the bottom of the well, wherein a wall of the well contains the spreading of the liquid over the surface.

According to a second embodiment the means to avoid the liquid spreading over the surface is a barrier selected from i) a hydrophilic barrier and ii) a hydrophobic barrier. In the case of a polar liquid, a hydrophobic barrier is used and with an a-polar liquid a hydrophilic one.

A further means that can be used is a charged barrier having a charge whose sign is the same as that of the liquid applied to the surface.

According to an alternative and/or additional embodiment the selected area to which liquid is to be applied may be provided with an agent promoting the spreading over the surface of the selected area. This could be a sugar or a surface-active agent. For example, the agent may be applied by means of pressure technique. This helps to ensure that the liquid will indeed cover the selected area. This is particularly important in cases where the selected area is not round, especially when it is angular such as a rectangle.

The present invention will now be explained with reference to the drawings in which FIG. 1 shows a device for performing the method according to the present invention;

Figure 1:
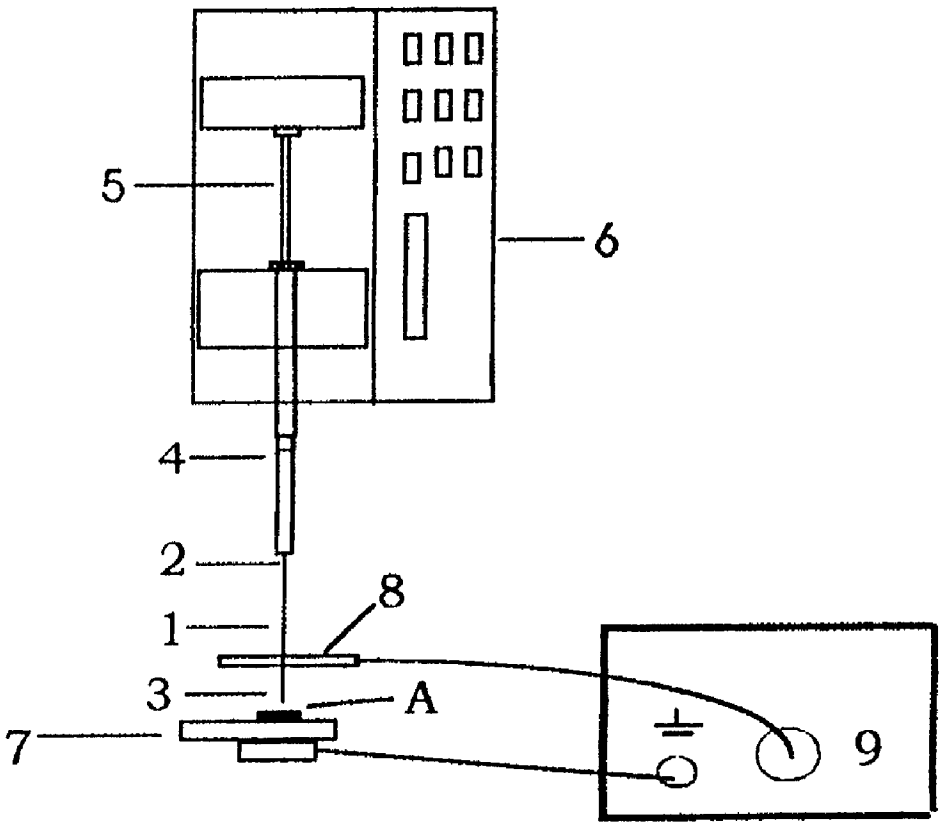

FIG. 1 shows a capillary 1 having a first tip 2 and a second tip 3. The first tip 2 is in communication with a 25 microliter Hamilton syringe 4. This syringe 4 contains the liquid, in the present case 0.3 M NaCl in an ethylene glycol-water mixture (70/30 vol. %/vol. %) to be applied to a substrate A. In the embodiment shown, the piston 5 of the syringe 4 is moved by a Harvard PHD 2000 infusion pump 6 (Antec, Leiden, the Netherlands). The infusion pump 6 moves the liquid B to the distal tip 3 of the capillary 1. The capillary 1 used here, has an inside diameter of 110 μm and an outside diameter of 210 μm. In the embodiment presented, the capillary 1 is made of metal.

The substrate A schematically shown in FIG. 1, is a semiconducting silicon micro-array having 25 wells formed by means of wet-etching, employing well-known techniques used in the semiconductor industry. The wells were rectangular with sides of 200 μm. The depth was 20 μm. The (semi)conducting substrate A is supported by a metal plate 7. The capillary 1 is connected with the positive electrode of a high voltage source 9 (HCN 12500, Air Parts, Alphen aan de Rijn, the Netherlands) via a metal holder 8, which may also comprise more than one capillary.

From the distal tip 3 of the capillary 1, the surface tension may be overcome by means of the high voltage of, for example, 1-2 kilovolt applied by means of the power source 9, resulting in extremely small droplets being moved from the second tip 3 to the substrate A, and more specifically to a well C provided therein. A well may be filled with more than one liquid, so that an assay can be performed in a very small reaction volume.

Figure 2:
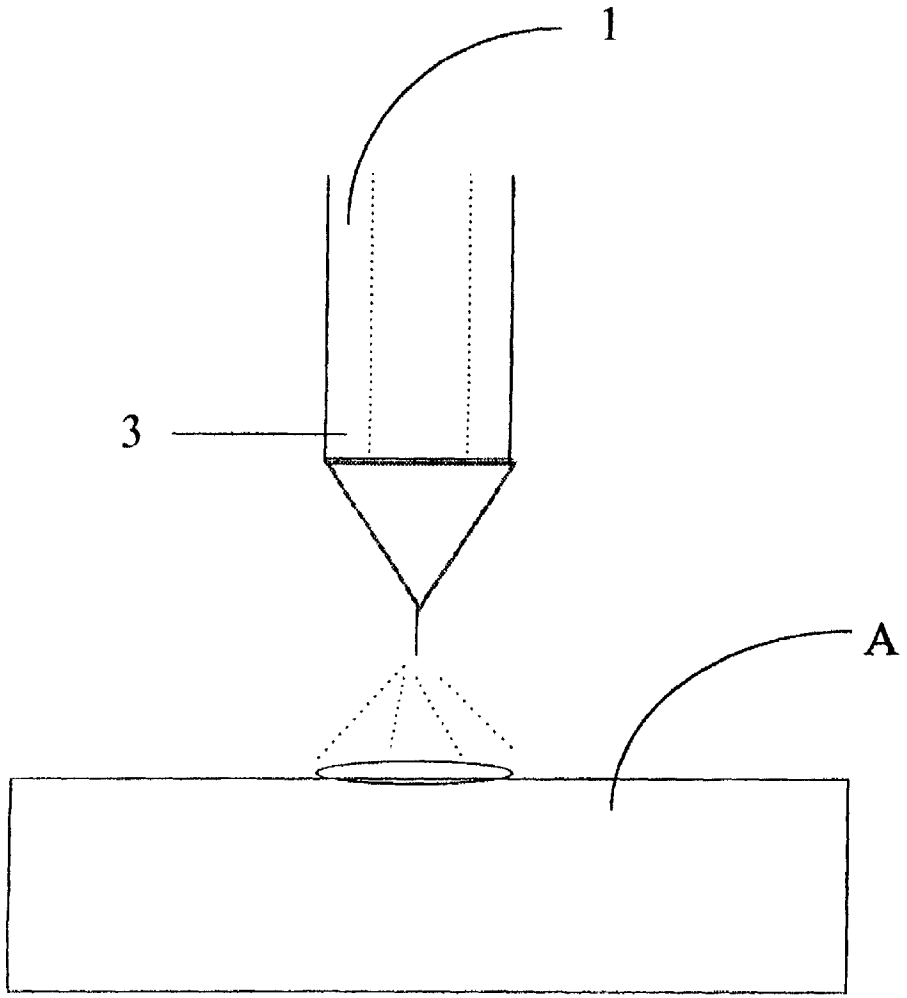
FIG. 2 shows a detail of an alternative embodiment.

Before applying the potential difference, superfluous liquid around the distal tip 3 is removed. FIG. 2 shows how a portion of the substrate A is coated with the liquid. The distal tip 3 of the capillary 1 (an outside diameter of 210 μm and an inside diameter of 110 μm) was positioned at a distance of 400-450 μm from the surface of the substrate A. A voltage of 1.45 kV was applied and the flow rate of the pump was 50 pl/s. When spraying 2-40 seconds, the diameter of the portion of the surface coated with liquid was 300-350 μm. Table I shows the results of measurement for a flow rate of 150 and 300 pl/s. When spraying continues for a long time, the thin liquid layer on the selected portion will form a drop which will have no adverse effect on the spraying, and there will be no break down.

TABLE I

Diameter of the selected portion in μm

| Flow rate 300 pl/s | | | | |
|---|---|---|---|---|
| Distance [μm] | 450 | 400 | 350 | 300 |
| Length of cone | 262.5 | 236.25 | 236.25 | 225.75 |
| Distance* [μm] | 187.5 | 163.75 | 113.75 | 74.25 |
| Pot. difference [Kv] | 1.34 | 1.29 | 1.22 | 1.22 |
| Diameter [μm] | 450 | 390 | 340 | 300 |

| Flow rate 150 pl/s | | | |
|---|---|---|---|
| Distance [μm] | 450 | 350 | 300 |
| Length of cone [μm] | 236.25 | 262.5 | 220.5 |
| Distance* [μm] | 213.75 | 87.5 | 79.5 |
| Pot. difference [Kv] | 1.34 | 1.2 | 1.2 |
| Diameter [μm] | 350 | 280 | 240 |

*Between tip of the conus of the liquid at the capillary and the substrate surface Selected portions of the surface of the substrate A may also be coated with an oligonucleotide probe. In the present invention an oligonucleotide probe is understood to mean any nucleic acid polymer having a length that is suitable for the selective hybridization with a complementary RNA- or DNA-strand in a sample to be examined.

For a person skilled in the art it is obvious that many different methods that are generally known in the art can be used for performing assays with the method according to the present invention. For example, the selected portions may be provided with (monoclonal) antibodies that may or may not be different, and which are able to recognize an antigen (or a variety of antigens) to be detected. To the person skilled in the art it will be obvious that it is also possible to apply together with the liquid, reagents such as an enzyme substrate, or an agent for detecting the formation of a complex. Also, if the biological particle is to be immobilized, a substrate suitable for the application of the biological particle and known in the art will be used. The surface then may or may not be capable of covalently binding this particle. For non-covalent immobilization of nucleic acids it is possible, for example, to use a gold surface.

The counter electrode may be a structure closed in itself whose centre, when projected onto the surface, will substantially coincide with the portion of the surface to be provided with the liquid. If the counter electrode is not located on the surface of the substrate, or if it is not held up to the same, so that it is therefore located between the substrate A and the second tip 3 of the capillary 1, then the surface of the cross section of the counter electrode will generally be smaller than the surface area of the selected portion. In most cases, the counter electrode will be an annular electrode, but other shapes, in particular rectangular counter electrodes are also possible. If a counter electrode is used that is not connected with the substrate, the counter electrode will generally be non-conductively connected with the capillary 1 in a permanent manner, and will preferably be adjustable at a distance from the second tip 3. This facilitates the reproducible application of liquid when a voltage is applied over the second tip 3 and the counter electrode.

If the liquid is to be applied to non-round portions of the surface, it is advisable to use a capillary and/or a counter electrode with a corresponding non-round shape. The counter electrode may be a non-flat counter electrode. With this type of counter electrode, the distance from any point of the electrode to the distal tip 3 of the capillary 1 is substantially constant.

Conceivably it is not the capillary 1 that is connected with the power source, but is the voltage between the second tip 3 and the counter electrode applied in a different manner. A possibility is, for example, that an electrode (not shown) is introduced in the liquid to be applied, which as the first electrode is connected to the high voltage source, and that the second electrode is formed by the substrate.

Such an embodiment may be especially useful when an array of capillaries is used, each of which is activated by an individual voltage. In such a case the syringes individually may be driven by a pump. If there is a risk of the adjacent capillaries influencing each other, the distance between the capillaries may also be increased, such as to be doubled, and those portions of the surface that are not covered by a capillary may be provided with liquid, after the array or the substrate have been suitably translated.

When using more than one capillary the voltage between a first capillary and the substrate may have an opposite polarity to the one between an adjacent capillary and the substrate. More particularly, it is then possible to fill one selected portion of the surface with two (or more) capillaries. This further limits the spreading of liquid outside the selected portion. This relates both to the spreading of sprayed liquid and the liquid already applied. The neutralization also means that less or no transportation of charge at all is necessary through the substrate, which further increases the range of substrates that can be used without separate electrodes that have to be held against the surface. In the situation described here it may be favourable that the distal tips of the capillaries facing the substrate do not extend parallel with each other but under an angle. Preferably, they are both directed towards the centre of the selected portion. The employment (preferably simultaneously) of two (or more) capillaries for the application of liquid to a selected portion, also offers various possibilities for performing reactions between the different liquids supplied through the capillaries. Attention is drawn especially to the fact that liquids can be mixed exceedingly well with the method according to the invention.

The liquid(s) to be applied by the method according to the invention has to possess sufficient conductibility, as is well known in the art. As mentioned above, the liquid may contain reagents, but also reagents on carriers or carriers to which reagents have to be applied. By means of the method according to the invention it is, for example, possible to apply to a selected portion of the substrate a colloidal solution of gold, latex or the like. Such substances are known to be excellent carriers for nucleic acid probes and antibodies.

In addition to varying the voltage or switching the spraying process on and off, it is also possible, simultaneously or alternatively, to increase the distance between capillary and substrate. Preferably this only takes a short time, such as a fraction of a second. It has been shown that increasing the distance does not substantially change the shape of the conus of the liquid, and that the application of the liquid is reproducible.

In order to have a reproducible starting-up behaviour and in general to maximize the control regarding the application, it may be advisable to obtain information about the liquid meniscus at the second tip 3. This can be done in different ways, for example by measuring the capacitance (by using an alternating current superposed on the high voltage direct current) or by optical means. In the latter case change in shape of the liquid meniscus may advantageously be used. For example, it is possible to couple light via the first tip 2 in the capillary 1, which capillary 1 works as wave conductor. The amount of light reflected by the meniscus is measured, to serve as parameter for operating the pump and for investigating the starting-up behaviour (the first forming of micro droplets). This behaviour will depend on the liquid used and the substances, such as salts, it comprises.

Figure 3:
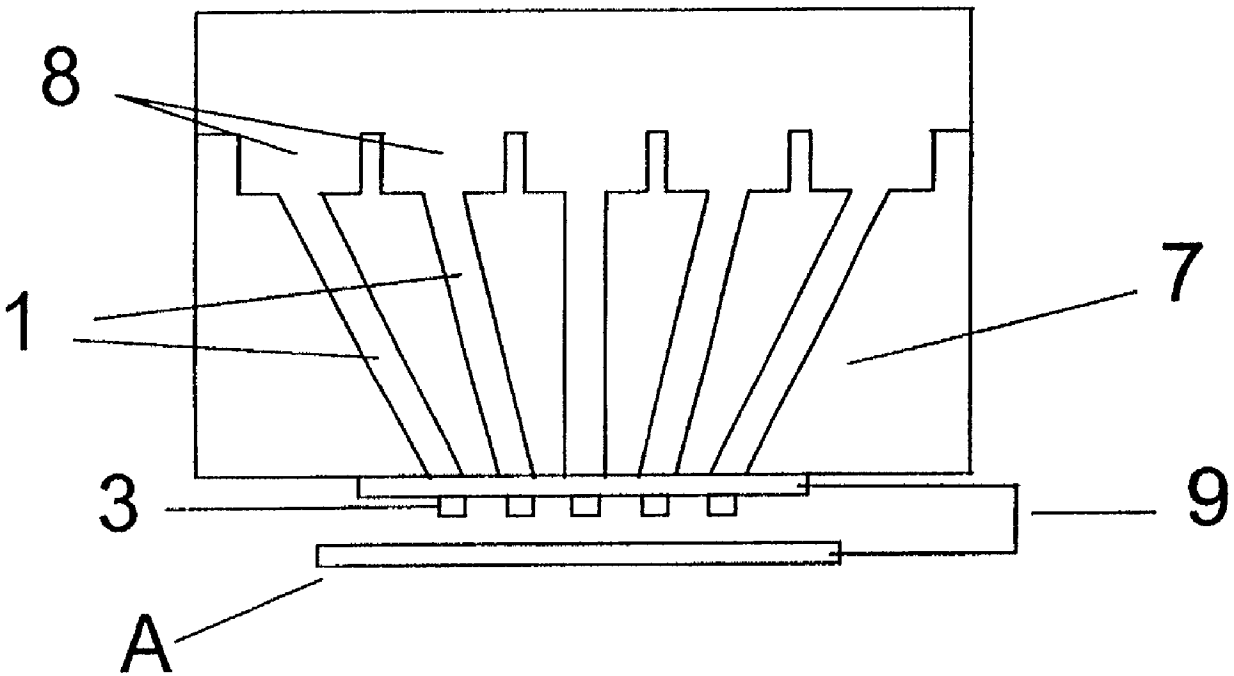
FIG. 3 shows a different embodiment of a device for the application of the method according to the invention.

A suitable embodiment of the device for the application of the present invention is shown in FIG. 3. In a block of plastic 7 capillaries 1 have been provided. To this end for example, a flat side of a first plastic portion has been provided with slots, after which a second portion part is attached to the side with the slots there-by creating the capillaries 1. The plastic portions may be bonded, for example, by using adhesives or other techniques known in the art. The ducts may be provided with reservoirs 8 cut into a third plastic portion each of which, at a proximal side of the capillaries 1, are in communication with one capillary. The plastic parts may be manufactured in any known suitable manner such as by injection moulding or hot embossing. The liquid may be displaced from a reservoir 8 by means of (gas) pressure serving all reservoirs 8 together or each reservoir individually.

At their distal end, the capillaries 1 are provided with orifices. This is preferably done by means of a chip provided with orifices with the aid of techniques known from the semiconductor industry. Conveniently, this chip is also provided with electrodes.

According to the invention, the counter electrode may cover the selected surface onto which liquid has to be applied, while the surface surrounding the selected surface conducts poorly or not at all. It is also possible that the selected surface is basically a surface that conducts poorly or not at all and that is provided with a large number of small electrodes distributed over the selected surface. Such embodiments can be manufactured by means of generally known production techniques for semiconductors.

A counter electrode may also be applied underneath the selected surface, which selected surface conducts poorly or not at all. However, the thickness of the thin film applied largely determines the amount of liquid that can be applied to the selected surface. In general, the thickness will be nominal. According to a special aspect of the invention this limitation, which results from a charge accumulation on the selected surface, may advantageously be used to economize on the amount of liquid applied to the selected surface.

The method according to the invention may also be used for the application of a liquid that solidifies at lower temperatures (such as agarose or the like) or that cures (for example, acrylamide), yielding an aqueous gel which provides a certain amount of form retention. Optionally the method according to the invention may be used to subsequently apply one or more further liquids, such as liquids comprising a reagent.

The invention claimed is:

1. A method of electrospray deposition for the dosed application of a liquid onto a surface of a target substrate (for analysis) comprising:

feeding the liquid to the distal tip of a capillary at a flow rate between 10 to 100 pl/s wherein the distal tip comprises an orifice directed toward the surface of the target substrate, and wherein the inside diameter of the distal tip of the capillary is 60 μm or less; and applying a voltage difference between the orifice or the liquid and a counter electrode or the target substrate until the desired amount of liquid has been applied to the surface, wherein the distance between the orifice and the surface of the target substrate is between 0.25 and 0.5 mm.

2. A method according to claim 1, wherein the liquid comprises a biological particle selected from the group consisting of an enzyme, a receptor and a ligand.

3. A method according to claim 1, wherein the distance between the orifice and the surface of the target substrate is 300 to 450 μm.

4. A method according to claim 1, wherein the surface of a target substrate further comprises a well with the selected portion being comprised of the bottom of the well, wherein a wall of the well contains spreading of the liquid over the surface.

5. A method according to claim 1, wherein the application is performed in an atmosphere substantially saturated with vapor from the liquid.

6. A method according to claim 1, wherein the application is performed in an atmosphere, which, in comparison with atmospheric air, reduces chance of discharge.

7. A method according to claim 1, wherein after the application of the liquid onto a surface of a first target on the substrate, the substrate and the orifice are moved in relation to each other in a plane extending substantially perpendicular to the axis of the capillary, and a second target on the substrate is provided with liquid, wherein the second target does not overlap with the first target provided with liquid.

8. A method according to claim 1, wherein an array of capillaries is used with the capillaries spaced from each other such that the selected surfaces onto which liquid is to be applied by two adjacent capillaries, do not overlap.

9. A method according to claim 1, wherein the counter electrode is formed by the substrate.

10. A method according to claim 1, wherein an electrode is used as counter electrode, which electrode substantially surrounds the selected portion of the surface and which is retained in vicinity to the surface.

11. A method according to claim 1, wherein the amount of applied liquid is measured by means of one or more characteristics from the group consisting of current and voltage characteristics.

12. A method according to claim 1, wherein a gelling liquid is applied to the selected portion of the surface.

13. A method according to claim 1, wherein the counter electrode is applied underneath the surface of the target substrate and is covered with a substantially insulating thin film.

* * * * *